US010066307B2

(12) United States Patent
Wright et al.

(10) Patent No.: US 10,066,307 B2
(45) Date of Patent: Sep. 4, 2018

(54) ELECTROLYTIC METHOD, APPARATUS AND PRODUCT

(71) Applicant: METALYSIS LIMITED, Rotherham (GB)

(72) Inventors: Allen Richard Wright, Gunnerton (GB); Stephen Holloway, Rotherham (GB)

(73) Assignee: METALYSIS LIMITED (GB)

( * ) Notice: Subject to any disclaimer, the term of this patent is extended or adjusted under 35 U.S.C. 154(b) by 0 days.

(21) Appl. No.: 14/401,462

(22) PCT Filed: May 10, 2013

(86) PCT No.: PCT/GB2013/051219

§ 371 (c)(1),
(2) Date: Nov. 14, 2014

(87) PCT Pub. No.: WO2013/171463

PCT Pub. Date: Nov. 21, 2013

(65) Prior Publication Data

US 2015/0129432 A1 May 14, 2015

(30) Foreign Application Priority Data

May 16, 2012 (GB) ..... 1208698.9

(51) Int. Cl.

| | |
|---|---|
| ***C25C 3/00*** | (2006.01) |
| ***C25C 3/02*** | (2006.01) |
| ***C25C 3/04*** | (2006.01) |
| ***C25C 3/06*** | (2006.01) |
| ***C25C 3/26*** | (2006.01) |
| ***C25C 3/28*** | (2006.01) |
| ***C25C 3/30*** | (2006.01) |
| ***C25C 3/32*** | (2006.01) |
| ***C25C 3/34*** | (2006.01) |

(52) U.S. Cl.

CPC ..... *C25C 3/00* (2013.01); *C25C 3/02* (2013.01); *C25C 3/04* (2013.01); *C25C 3/06* (2013.01); *C25C 3/26* (2013.01); *C25C 3/28* (2013.01); *C25C 3/30* (2013.01); *C25C 3/32* (2013.01); *C25C 3/34* (2013.01)

(58) Field of Classification Search

CPC ..... C25C 3/26; C25C 3/28; C25C 3/00–3/36
See application file for complete search history.

(56) References Cited

U.S. PATENT DOCUMENTS

| | | | | |
|---|---|---|---|---|
| 2,845,386 | A | 7/1958 | Olson | |
| 7,264,765 | B2 | 9/2007 | Ono et al. | |
| 2004/0237711 | A1 | 12/2004 | Ono et al. | |
| 2007/0181436 | A1* | 8/2007 | Mukunthan et al. | 205/398 |
| 2009/0045070 | A1* | 2/2009 | Becker | C25C 5/04 205/220 |
| 2010/0006448 | A1 | 1/2010 | Dring et al. | |

FOREIGN PATENT DOCUMENTS

| | | |
|---|---|---|
| CN | 1246897 | 3/2000 |
| CN | 1309724 | 8/2001 |
| CN | 1748047 | 3/2006 |
| DE | 1096043 | 12/1960 |
| EP | 1445350 | 8/2004 |
| JP | 2003-129268 | 5/2003 |
| JP | 2003306725 | 10/2003 |
| JP | 2007-520627 | 7/2007 |
| WO | WO 98/33956 | 1/1998 |
| WO | WO 99/64638 | 12/1999 |
| WO | WO 2004/053201 | 6/2004 |
| WO | WO 2004/113593 | 12/2004 |
| WO | WO 2006027612 | 3/2006 |

(Continued)

OTHER PUBLICATIONS

EHKTechnologies. "Summary of Emerging Titanium Cost Reduction Technologies." Jan. 2004.*

Ono, K. and Suzuki, R.O. "A New Concept for Producing Ti Sponge: Calciothermic Reduction." The Journal of the Minerals, Metals & Materials Society (TMS). vol. 54, Issue 2. Feb. 2002. pp. 59-61.*

Suzuki, R.O. and Fukui, S. "Reduction of TiO2 in Molten CaCl2 by Ca Deposited during CaO Electrolysis." Materials Transactions, vol. 45, No. 5. pp. 1665 to 1671. 2004 (no month).*

G.Z. Chen, D. J. Fray, T.W. Farthing. "Direct electrochemical reduction of titanium dioxide to titanium in molten calcium chloride" Nature. vol. 407, No. 6802. Sep. 21, 2000. pp. 361-364.*

Suzuki, R. and Ono, K. "A new concept of sponge titanium production by calciothermic reduction of titanium oxide in the (Continued)

*Primary Examiner* — Steven A. Friday

(74) *Attorney, Agent, or Firm* — Saliwanchik, Lloyd & Eisenschenk

(57) ABSTRACT

In a method for removing a substance from a feedstock comprising a solid metal or a solid metal compound, the feedstock is contacted with a fused-salt melt. The fused-salt melt contains a fused salt, a reactive-metal compound, and a reactive metal. The fused salt comprises an anion species which is different from the substance, the reactive-metal compound comprises the reactive metal and the substance, and the reactive metal is capable of reaction to remove at least some of the substance from the feedstock. A cathode and an anode contact the melt, and the feedstock contacts the cathode. An electrical current is applied between the cathode and the anode such that at least a portion of the substance is removed from the feedstock. During the application of the current, a quantity of the reactive metal in the melt is maintained sufficient to prevent oxidation of the anion species of the fused salt at the anode. The method may advantageously be usable for removing the substance from successive batches of the feedstock, where the applied current is controlled such that the fused-salt melt after processing a batch contains the quantity of the reactive metal sufficient to prevent oxidation of the anion species at the anode.

24 Claims, No Drawings

(56) References Cited

FOREIGN PATENT DOCUMENTS

WO WO 2007014422 2/2007

OTHER PUBLICATIONS molten $CaCl_2$" presented at the AG1-Thirteenth Int'l Symposium on Molten Salts, during the 201st Meeting of the Electrochemical Society, Philadelphia, PA; Abstract No. 1476, May 13, 2002.

*A collection of translated methods of producing titanium by electrolysis*, 1st edition, edited by Shanghai Second Smeltery, Institute of Nonferrous Metal Research, Shanghai, and Institute of Scientific & Technical Information of Shanghai, pp. 20-22, published Oct. 31, 1973.

Xuguang, Y. et al. "Preparation of Al—Si alloy by molten salt electrolysis", *Journal of Northeastern University* (*Natural Science*), May 15, 2004, vol. 25, No. 5, pp. 442-444.

Zheng, H. et al. "New technologies on direct production of metallic titanium from $TiO_2$" *The Chinese Journal of Process Engineering*, Jun. 15, 2009, vol. 9, No. S1, pp. 448-452.

English language translation of Office Action issued in Chinese Patent Application No. 201380037209.9, dated Apr. 5, 2016.

English language translation of Office Action issued in Japanese Patent Application No. 2015- 512118, dated Mar. 14, 2017.

* cited by examiner

ELECTROLYTIC METHOD, APPARATUS AND PRODUCT

CROSS-REFERENCE TO RELATED APPLICATION

This application is the National Stage of International Application No. PCT/GB2013/051219, filed May 10, 2013, which is hereby incorporated by reference herein in its entirety, including any figures, tables, nucleic acid sequences, amino acid sequences, or drawings.

The invention relates to an electrolytic method for removing a substance from a solid feedstock to form a product, an apparatus for carrying out the method, and the product of the method.

A known process for electro-reduction, or electro-decomposition, of a solid feedstock is carried out by electrolysis in an electrolytic cell containing a fused-salt melt. The solid feedstock comprises a solid compound between a metal and a substance or of a solid metal containing the substance in solid solution. The fused salt comprises cations of a reactive metal capable of reacting with the substance to remove the substance from the feedstock. For example, as described in patent publication WO 99/64638 the feedstock may comprise $TiO_2$ and the fused salt may comprise Ca cations. WO 99/64638 describes a batch process in which a quantity of feedstock is cathodically connected and contacted with a melt, and an anode is contacted with the melt. A potential is applied between the cathode and the anode so that the cathode potential is sufficient to cause the substance to dissolve from the feedstock into the melt. The substance is transported in the melt to the anode and is removed from the melt by an anodic reaction. For example if the feedstock is $TiO_2$ the substance is oxygen, and the anodic reaction may evolve oxygen gas or, if a carbon anode is used, CO or $CO_2$ gas.

WO 99/64638 states that the reaction at the cathode depends on the cathode potential and that the cathode potential should be maintained below the reactive-metal cation deposition potential. The substance can then dissolve in the melt without any deposition of the reactive metal on the cathode surface. If the cathode potential is higher than the reactive-metal cation deposition potential, then the fused-salt melt can decompose and the reactive metal can be deposited on the cathode surface. WO 99/64638 therefore explains that it is important that the electrolytic process is potential controlled, to avoid the cathode potential exceeding the reactive-metal deposition potential.

Patent application WO 2006/027612 describes improvements to the method of WO 99/64638, in particular for reduction of batches of a $TiO_2$ feedstock in a $CaCl_2$/CaO melt with a C (graphite) anode. This prior art explains that CaO is soluble in $CaCl_2$ up to a solubility limit of about 20 mol % at a typical melt temperature of 900° C., and that when $TiO_2$ feedstock contacts a melt of $CaCl_2$ containing CaO, the $TiO_2$ and CaO react to form solid calcium titanates, thus removing CaO from the melt. WO 2006/027612 also notes that during electro-reduction there must be sufficient oxygen (or CaO) dissolved in the melt to enable the reaction of oxygen at the anode (to evolve $CO_2$). If the level of oxygen in the melt is too low, then the rate of oxygen reaction at the anode becomes mass transfer limited and if current is to flow another reaction must occur at the anode, namely the evolution of $Cl_2$ gas. This is highly undesirable as $Cl_2$ is polluting and corrosive. As a consequence, WO 2006/027612 teaches that the molar quantity of CaO in the melt and the molar quantity of feedstock ($TiO_2$) loaded into the cell must be predetermined such that after the formation of calcium titanates the melt still contains sufficient CaO to satisfy the required transport of oxygen from the cathode to the anode and the reaction at the anode to form $CO_2$.

WO 2006/027612 also discusses a second problem, namely that if the rate of dissolution of oxygen from the feedstock is too high, then the concentration of CaO in the melt in the vicinity of the feedstock may rise above the solubility limit of CaO in $CaCl_2$ and CaO may precipitate from the melt. If this occurs adjacent to the feedstock or in pores in a porous feedstock the precipitated solid CaO may prevent further dissolution of oxygen from the feedstock and stall the electro-reduction process. WO 2006/027612 teaches that this may be a particular problem in the early stages of an electro-reduction process when the quantity of oxygen in the feedstock is at its maximum and the rate of dissolution of oxygen from the feedstock may be highest. WO 2006/027612 therefore proposes a gradual increase in the cell potential at the start of the electro-reduction of a batch of feedstock, from a low voltage level up to a predetermined maximum voltage level, so as to limit the rate of oxygen dissolution and avoid CaO precipitation.

An alternative approach to removing a substance from a solid feedstock in contact with a fused salt is described in prior art documents such as U.S. Pat. No. 7,264,765 and a paper "A New Concept of Sponge Titanium Production by Calciothermic Reduction of Titanium Oxide in Molten Calcium Chloride" by K. Ono and R. O. Suzuki in J. Minerals, Metals. Mater. Soc. 54[2] pp 59-61 (2002). This method involves electrolysis of a fused-salt melt to generate a reactive metal in solution in the melt, and using the reactive metal chemically to react with the substance in a solid feedstock. In a melt such as $CaCl_2$/CaO, electrolysis of the melt involves decomposition of the CaO, which has a lower decomposition potential than $CaCl_2$ as described in U.S. Pat. No. 7,264,765, to generate Ca metal at the cathode and $CO_2$ at a C anode. The Ca metal dissolves in the melt and when the solid feedstock, such as $TiO_2$, is contacted with the melt it reacts with the dissolved Ca to produce a Ti metal product. In this method, which may be termed calciothermic reduction, the solid feedstock is conventionally not in contact with the cathode.

One prior art document, WO 03/048399 describes electro-reduction by a combination of cathodic dissolution of a substance from a solid feedstock and by calciothermic reduction in a single process. WO 03/048399 states that the current efficiency of the low-potential cathodic dissolution process disadvantageously falls in the later stages of the reaction, as the concentration of the substance in the feedstock falls, and suggests switching to calciothermic reduction after partial removal of the substance from the feedstock by low-potential electro-reduction. Thus WO 03/048399 proposes applying a low cathode potential initially, so that some of the substance dissolves from the feedstock into the melt. It then proposes either removing the applied cell potential and adding Ca metal to the melt to act as a chemical reductant, or temporarily increasing the cell potential to a level sufficient to decompose the melt and generate Ca metal in situ, before removing the applied cell potential and allowing chemical reaction between the Ca and the feedstock to proceed.

Thus, the known prior art discussing mechanisms and processes for electro-reduction focuses on determining or controlling the cathode potential in order to determine the nature of the reaction at the cathode, and on maximising the efficiency of the electro-reduction reaction at all stages of the process.

However, the prior art does not teach the skilled person how to scale up the electro-reduction process for commercial use. In a commercial process for extracting a metal from a metal compound, such as a metal ore, using an electrolytic process it is very desirable to operate the process at the highest possible current density. This minimises the time taken to extract a quantity of metal product and advantageously reduces the size of the apparatus required for the process. For example a conventional Hall-Heroult cell for producing aluminium may operate at an anode current density of 10,000 $Am^{-2}$.

At present there are no known processes for electro-reduction of solid feedstocks on a commercial scale. The known prior art describes various experimental-scale processes and theoretical proposals for larger-scale operation, and the most effective of these aim to reduce solid-oxide feedstocks in melts consisting either of CaO dissolved in $CaCl_2$ or of $Li_2O$ dissolved in LiCl. The reactions proceed by removing oxygen from the feedstock at the cathode, transporting the oxygen through the melt in the form of the dissolved CaO or $Li_2O$, and removing the oxygen from the melt at the anode, usually by reaction at a C anode to form $CO_2$. In all cases, however, if an attempt is made to impose a higher current or potential between the cathode and anode, then polarisation of the reaction of O at the anode occurs, the anode potential rises and the chloride in the fused salt reacts at the anode to produce $Cl_2$ gas. This is a significant problem as $Cl_2$ gas is poisonous, polluting and corrosive.

It is an object of the invention to solve the problem of $Cl_2$ gas evolution at the anode of electro-reduction cells at high current density.

SUMMARY OF INVENTION

The invention provides a method for removing a substance from a solid feedstock, an apparatus for implementing the method, and a metal, alloy or other product of the method, as defined in the appended independent claims to which reference should now be made. Preferred or advantageous features of the invention are set out in dependent sub-claims.

In a first aspect the invention may thus provide a method for removing a substance from a solid feedstock comprising a solid metal or metal compound. (The feedstock may comprise a semi-metal or semi-metal compound, but for brevity in this document the term metal shall be taken to include metals and semi-metals.) The method comprises providing a fused-salt melt, contacting the melt with a cathode and an anode, and contacting the cathode and the melt with the feedstock. A current or potential is then applied between the cathode and anode such that at least a portion of the substance is removed from the feedstock to convert the feedstock into a desired product or product material.

The melt comprises a fused salt, a reactive-metal compound, and a reactive metal. The fused salt comprises an anion species which is different from the substance to be removed from the feedstock. The reactive-metal compound comprises cations of the reactive metal and anions of the substance, or comprises a compound between the reactive metal and the substance. The reactive metal is sufficiently reactive to be capable of reacting with the substance to remove it from the feedstock.

In this melt composition, the reactive metal species in the melt can advantageously be oxidised at the anode and reduced at the cathode, and may therefore be able to carry current through the melt. (More precisely, the reactive metal, which is preferably in solution in the melt, is oxidised to form cations of the reactive metal at the anode, and the cations are reduced to the reactive metal species at the cathode.) The quantity, or concentration, of the reactive metal in the melt is sufficient to carry sufficient current through the melt to prevent oxidation of the anion species of the fused salt at the anode when a desired current is applied to the cell. Advantageously, this may permit the application of a current or potential between the cathode and anode which is sufficiently large, or high, that in the absence of the quantity of the reactive metal in the melt (or with a lower, or smaller, quantity of the reactive metal in the melt) the application of the current or potential would cause oxidation of the anion species at the anode.

The method is preferably implemented as a batch process or as a fed-batch process, though it may also be applicable to continuous processes. In a fed-batch process, materials may be added to or removed from a reactor while a load or batch of feedstock is being processed. For brevity in this document the term batch process shall be taken to include fed-batch processes.

The first aspect of the invention may be illustrated with reference to a preferred, but non-limiting, embodiment, namely the removal of oxygen from a solid $TiO_2$ feedstock in a $CaCl_2$-based melt. The cathode may then be a stainless-steel tray onto which a batch of the $TiO_2$ may be loaded, and the anode may be of graphite. The $TiO_2$ may be in the form of porous pellets or a powder, as described in the prior art. The melt comprises $CaCl_2$ as the fused salt, CaO as the reactive-metal compound and Ca as the reactive metal.

As described above, the prior art teaches that when a conventional $CaCl_2$ melt, containing only $CaCl_2$ and a quantity of CaO, is used, and an applied current or potential is greater than a predetermined level, the anode reaction becomes polarised so that instead of $CO_2$ evolution, chloride anions in the melt are converted to $Cl_2$ gas. This is highly disadvantageous, and prevents the application of currents, or current densities, which are sufficiently high for a commercially-viable electro-reduction process.

The present invention in its first aspect addresses this problem by including the reactive metal (Ca in the embodiment) as a component of the fused-salt melt. This enables at least a portion of the current between the cathode and anode to be carried by the reaction of $Ca^{2+}$ cations to form Ca at the cathode and Ca at the anode to form $Ca^{2+}$. The availability of this mechanism of oxidising and reducing the reactive metal in the melt for carrying current between the cathode and anode allows the electrolytic cell to carry a higher current, or current density, without polarisation at the anode becoming sufficient to evolve $Cl_2$ gas. For example, in a cell in which the melt comprises $CaCl_2$, CaO and Ca, current may be carried by both the evolution of oxygen (or CO or $CO_2$ if a graphite anode is used) at the anode and by the oxidation of Ca to form Ca ions at the anode, without the anode reaching a potential at which $Cl_2$ may be evolved.

In the prior art, and according to the technical prejudice of the skilled person, the steps of including the reactive metal in the melt in an electro-reduction cell and operating the cell as in the first aspect of the present invention described above would be seen to be a significant disadvantage. This is because the current carried by the reaction of the reactive metal and its cations at the cathode and anode does not contribute to the removal of the substance from the solid feedstock. The skilled person's technical prejudice would therefore be that this process is disadvantageous because it reduces the mass of feedstock which can be reduced by a given quantity of electrical charge flowing between the cathode and anode, and therefore reduces the overall current efficiency of the cell. But the inventors have appreciated that this apparent disadvantage, of reduced current efficiency, is outweighed by the advantage of being able to operate a cell at an increased anode current density without evolving $Cl_2$ gas (in the embodiment using a $CaCl_2$-based melt).

This aspect of the invention is particularly advantageous in a method operated under an imposed current or under current control, as is desirable in a commercial-scale electrolysis process. If a process is potential-controlled then the anode potential may be monitored and the potential applied to the cell may be controlled and limited so as to avoid $Cl_2$ evolution, but in a large-scale apparatus operating at high currents such control is not straightforward. It is preferable to operate such an apparatus under current control and it is then highly advantageous to include a quantity of the reactive metal in the melt in order to avoid $Cl_2$ formation.

The imposed current need not be a constant current throughout the processing of a batch of feedstock, but may be changed or controlled according to a predetermined current profile.

It should be noted that the reaction conditions may change very significantly during the processing of a batch of feedstock. For example as a batch of an oxide feedstock is reduced to metal, the oxygen content of the feedstock may be reduced by several orders of magnitude. Also, early in the process, if metal oxides such as Ti oxides are processed in a melt comprising CaO, calcium titanates will form and reduce the quantity of CaO in the melt, limiting the transport of oxygen in the melt to the anode and therefore the ability of the oxygen reaction at the anode to carry current. Later in the process the calcium titanates are decomposed as oxygen is removed from the feedstock and the CaO absorbed in forming the titanates is returned to the melt. Also, oxygen removal from the feedstock into the melt may be higher at the start of the process, when the oxygen content of the feedstock is high, than at the end when its oxygen content is lower. Thus, as the reaction progresses, the quantity of O (or CaO) in the melt changes and so the quantity of O transported to the anode and the concentration of O (or $O^{2-}$ ions) in the melt at the anode changes with time. Consequently, the maximum current which the reaction of O at the anode is capable of carrying changes with time. If a batch of feedstock is to be processed at constant current, for example, and the melt contains only $CaCl_2$ and CaO (and no Ca), then the capacity of the anodic reaction of $O^{2-}$ to carry current may be at a minimum when the oxide concentration of the melt is at its minimum. In order to avoid evolving $Cl_2$ at any time, a constant current applied throughout the processing of a batch of feedstock cannot then exceed this minimum current-carrying capacity of the oxide reaction at the anode. The constant current will then disadvantageously be less than the current which could be applied without evolving $Cl_2$ at any other time in the reaction. The removal of oxygen from the feedstock then takes place at its maximum possible rate only at the time when the oxygen transport to the anode is at its minimum. At all other times the reaction is driven disadvantageously slower than the available capacity of the oxygen reaction at the anode, thus increasing the total time required to process a batch of feedstock.

By adding the reactive metal, such as Ca, to the melt the inventors have removed this limitation. When the oxide concentration in the melt is low or at its minimum, the reaction of Ca to form Ca cations at the anode provides a mechanism for additional current to flow without formation of $Cl_2$. Under constant-current conditions a higher cell current, or anode current density, can then be applied throughout the processing of a batch without evolving $Cl_2$ at any time. The portion of the current carried by the reactive-metal reaction at the anode does not cause evolution of oxygen (or CO or $CO_2$) at the anode and therefore does not contribute directly to the removal of oxygen from the feedstock. Consequently, while current, or a proportion of the total cell current, is being carried by the reactive-metal reaction at the anode, the current efficiency of the removal of the substance from the feedstock may be temporarily reduced, but this disadvantage may advantageously be outweighed by the ability to apply the increased current to the cell at other times. At times when the oxide concentration in the melt is higher, oxygen can then be removed more rapidly from the melt at the anode, and so oxygen can be removed more rapidly from the feedstock. This may advantageously decrease the total time for processing a batch of feedstock.

The same advantage may similarly apply under other imposed-current conditions, which may include the application of predetermined varying currents such as the imposition of a predetermined current profile or anode current density profile. In each case, for some or all of the processing of a batch, the applied current may advantageously exceed the current-carrying capacity of the oxide reaction at the anode without evolving $Cl_2$ (in the embodiment using a $CaCl_2$-based melt).

A process operated under potential control may also benefit from this advantage. For example if in a commercial process a batch process is repeated, an imposed current profile may be applied either by controlling the current directly or by applying a potential profile which results in the desired current profile.

The limiting current which can be applied to a particular process embodying the first aspect of the invention can be evaluated with reference to a Damköhler number for the process.

Definition: Damköhler Number

The Damköhler numbers (Da) are dimensionless numbers used in chemical engineering to relate chemical reaction timescale to other phenomena occurring in a system such as mass transfer rates. The following description is in the context of electro-reduction of metal oxides in $CaCl_2$-based melts, but as the skilled person would appreciate, similar analysis applies to any electro-reduction system.

Da=(reaction rate)/(convective mass transfer rate)

For the case of the anode reaction in electro-reductions of metal oxides such as $TiO_2$ or $Ta_2O_5$, the total rate of reaction at an anode (mol/s) is given by:

$$\frac{I}{zF} \tag{1}$$

The limiting rate (for avoidance of chlorine evolution) of convective mass transfer of CaO to the anode is given by:

$$Ak_l C_{CaO} \text{ (mol/s)} \tag{2}$$

Where I is the anode current (Amps), $C_{CaO}$ is the concentration of CaO dissolved in the electrolyte (gmol/$m^3$), A is the anode area ($m^2$) and $k_l$ is the convective mass transfer coefficient ($ms^{-1}$).

Then $$Da = \frac{\frac{I}{zF}}{Ak_l C_{CaO}} \tag{3}$$

If Ca metal is also present in the electrolyte it will also be oxidised to $Ca^{2+}$ at the anode. The current at the anode is made up from the sum of the partial currents so equation 3 becomes $$Da = \frac{\frac{I}{zF}}{Ak_l(C_{Ca} + C_{CaO})} \tag{4}$$

Defining a parameter φ as $$\varphi = \frac{(C_{Ca} + C_{CaO})}{C_{CaO}} \tag{5}$$

$$\varphi C_{CaO} = (C_{Ca} + C_{CaO}) \tag{6}$$

For both Ca metal and $Ca^{2+}$ anions z=2 and equation (4) becomes $$Da = \frac{I}{2FA\varphi k_l C_{CaO}} \tag{7}$$

When metal oxides ($M_nO_m$) are present in the electrolyte the calcium oxide is depleted (for example by reaction with a titanium oxide feedstock to form calcium titanates) according to the equation:

$$CaO + \sigma M_nO_m \rightarrow Ca\sigma MO_{(\sigma+1)} \quad (\sigma\text{=stoichiometric coefficient})$$

Therefore the CaO concentration term in equation (7) will be depleted by the presence of metal oxide at the start of the electrolysis by $\sigma M_nO_m$ gmol/liter of electrolyte.

$$Da = \frac{I}{2FA\varphi k_l(C_{CaO} - \sigma \mathrm{MnOm})} \tag{8}$$

Expressing the levels of CaO and $M_nO_m$ in terms of their wt % of the electrolyte ($x_i$) equation (8) becomes $$Da = \frac{I}{40000\ FA\varphi k_l\left(\frac{x_{CaO}}{MW_{CaO}} - \frac{\sigma x_{MnOm}}{MW_{MnOm}}\right)} \tag{9}$$

For 1<Da<1 no chlorine will be evolved.
For Da>1 chlorine will be evolved.

By adding Ca metal to the electrolyte the parameter φ will be increased according to equation (5) and Da will be reduced according to (9).

Therefore for a given combination of current, metal oxide loading, anode area, CaO concentration, and forced convection (or other mass transfer mechanism), Ca may advantageously be added to the electrolyte to reduce Da to a value of less than 1.0.

In order to minimise the time taken to process a batch of feedstock, and/or to produce a maximum mass of product from a particular electrolysis cell in a particular time, it is desirable to operate the cell with the highest possible Damköhler number without exceeding Da=1. Thus a cell may advantageously be operated by applying a current, or current profile, such that 0.7<Da<1, or 0.8<Da<1, throughout at least 50%, or preferably at least 60% or 70% or 80% or 90% of the duration of the process.

This typically requires starting processing a batch of feedstock with a maximum concentration of the reactive metal (e.g. Ca) in the electrolyte, and applying a current or current profile so that the concentration of the reactive metal (e.g. Ca) drops and the concentration of the reactive-metal compound (e.g. CaO) in the electrolyte rises during removal of the bulk of the substance from the feedstock, before the concentration of the reactive metal (e.g. Ca) increases back to its maximum concentration, and the reactive-metal compound concentration correspondingly falls, at the end of the processing of the batch. The solubility limits for the reactive metal and for the reactive-metal compound are preferably not exceeded, anywhere in the electrolyte, at any time.

A second aspect of the invention provides a method for removing a substance from successive batches of a feedstock comprising a solid metal or metal compound, by a batch process in which the fused-salt melt is re-used to process successive batches of feedstock. The fused-salt melt at the start of processing each batch may advantageously comprise a fused salt, a reactive-metal compound and a reactive metal. The fused salt comprises an anion species which is different from the substance in the feedstock. The reactive-metal compound comprises the reactive metal and the substance, or in other words comprises a compound between the reactive metal and the substance. The reactive metal is advantageously capable of reaction to remove at least a portion of the substance from the feedstock.

The melt is contacted with a cathode and an anode, and the cathode and the melt are contacted with a batch of feedstock. These steps need not be carried out in this order. For example, a reaction vessel or electrolysis cell may be filled with the melt, and the cathode, the anode and/or the feedstock lowered into the melt. Alternatively, the cathode, the anode and/or the feedstock may be positioned in the reaction vessel, which may then be filled with the melt.

The batch of feedstock is processed by applying a current between the cathode and the anode so that at least a portion of the substance is removed from the feedstock to produce a product. The applied current is controlled such that the melt at an end of the process, for example when a desired portion of the substance has been removed from the feedstock, contains a predetermined quantity of the reactive-metal compound and/or of the reactive metal. The product may then be removed from the melt, leaving a melt having a predetermined composition suitable for re-use to process a further (optionally similar or identical) batch of feedstock.

The composition of the melt at the end of processing a batch of feedstock is therefore advantageously the same as the composition of the melt at the start of processing the next batch of feedstock. Consequently, the melt may be re-used many times, such as ten times or more for processing ten or more batches of feedstock.

As described above in relation to the first aspect of the invention, the presence of a quantity of the reactive metal in the melt at the start of an electro-reduction process may advantageously increase the level of current or potential which can be applied between the cathode and the anode without causing an anodic reaction involving the anion in the fused salt, which may, for example, be chloride in a $CaCl_2$-based melt.

Since one of the reactions which may occur in the melt is the decomposition of the reactive-metal compound to produce the reactive metal at the cathode, the current applied during the processing of a batch of feedstock may be controlled so as to produce a desired quantity of the reactive metal and/or the reactive-metal compound in the melt at the end of processing a batch. The current applied, and other parameters such as the time for which the current is applied, may thus be controlled so that the melt at the end of processing a batch is suitable for re-use for processing the next batch, and in particular for the start of processing the next batch.

Advantageously, the melt at the end of processing a batch may thus contain between 0.1 wt % or 0.2 wt % and 0.7 wt %, and preferably between 0.3 wt % and 0.5 wt %, of the reactive metal, and/or between 0.5 wt % and 2.0 wt %, and preferably between 0.8 wt % and 1.5 wt %, of the reactive-metal compound. An advantageously high current may then be applied for processing the next batch, including at the start of processing the next batch, while avoiding reaction of the fused-salt anion at the anode. In other words, an advantageously high current may be applied without exceeding a Damköhler number of 1.

The sum of the concentrations of the reactive metal and the reactive-metal compound at the beginning and end of the processing of a batch may be the same, for example between 0.8% and 2% or between 1% and 1.6%, or about 1.3%.

Applying a current towards the end of processing a batch which is sufficient to decompose a portion of the reactive-metal compound in the melt, and increase the quantity of the reactive metal in the melt, may provide a further advantage in allowing the process to achieve a lower concentration of the substance in the feedstock, and producing a product containing an advantageously low concentration of the substance. This is because the minimum concentration, or activity, of the substance in the product which can be attained may be affected by the concentration, or activity, of the same substance in the melt. If, for example, the substance is oxygen, the minimum level of oxygen in the product may advantageously be reduced if the activity of oxygen in the melt can be reduced towards the end of processing a batch of feedstock. The concentration of oxygen in the melt may advantageously be reduced by decomposing a portion of the reactive-metal compound (for example, CaO) in the melt towards the end of processing a batch.

In further aspects, the invention may advantageously provide a product of the methods described and apparatus for implementing the methods. For example, a suitable apparatus may comprise a means for handling the melt so that it can be re-used. This may involve withdrawal of the product from the melt and insertion of a fresh batch of feedstock into the melt. Alternatively, the melt-handling apparatus may be capable of withdrawing the melt from the reaction vessel before the product is removed and a new batch of feedstock placed in the vessel, and then returning the melt to the reaction vessel for re-use.

If a melt is to be re-used for electro-reduction of successive (optionally similar or identical) batches of feedstock, it is initially necessary to provide a melt of a suitable composition for the electro-reduction of the first of the batches of feedstock. This may be achieved either by preparing a melt directly, or by carrying out an initial electro-reduction process under different conditions from subsequent electro-reduction processes (in which the melt is being re-used).

If a melt is prepared directly, then appropriate quantities of the fused salt, the reactive-metal compound and the reactive metal may be mixed, to prepare a melt which is suitable for re-use to process successive batches of feedstock under substantially-identical conditions.

If a melt suitable for re-use is to be prepared by carrying out an initial electro-reduction process then, for example, predetermined quantities of the fused salt, the reactive-metal compound and/or the reactive metal may be mixed, and this melt used for electro-reduction of a quantity of feedstock, which may or may not be the same quantity as in a subsequent batch of feedstock. Importantly, the current applied during the initial electro-reduction process may advantageously be lower than the current applied during subsequent batch processing, in order to avoid reaction of the fused-salt anion at the anode (i.e. to avoid exceeding a Damköhler number of 1). The initial electro-reduction process may be continued at an appropriate current and an appropriate time to produce a melt having the required composition for re-use in successive batch processing.

The initial processing of a batch to produce a melt suitable for re-use is very different from the process of "pre-electrolysis" carried out in the prior art to prepare a melt for a single electrolysis procedure. "Pre-electrolysis" of a fused-salt melt is carried out at very low current density and its purpose is to remove water from the melt and to purify the melt by electrodepositing metallic trace elements at a cathode. The aim of conventional pre-electrolysis is not to decompose the reactive-metal compound in the melt, and thereby to increase the quantity of reactive metal dissolved in the melt. As described above, the skilled person in the prior art would consider the production of the reactive metal in the melt to be highly disadvantageous because of the subsequent reduction in current efficiency of electro-reduction.

The various aspects of the invention described above may be applied to substantially any electro-reduction process for removing a substance from a solid feedstock. Thus, for example, batches of feedstock containing more than one metal or metal compound may be processed to produce alloys or intermetallic compounds. The method may be applied to a wide range of metals or metal compounds, containing metals such as Ti, Ta, beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, and the lanthanides including lanthanum, cerium, praseodymium, neodymium, samarium, and the actinides including actinium, thorium, protactinium, uranium, neptunium and plutonium. Various reactive metals may be used, subject to the requirement that the reactive metal is sufficiently reactive to be capable of removing at least a portion of the substance from the feedstock. Thus, for example, the reactive metal may comprise Ca, Li, Na or Mg.

Chloride-based electrolytes such as $CaCl_2$, LiCl, NaCl or $MgCl_2$ may be used, as may other halide-based or other electrolytes, or mixtures of such compounds. In each case, the skilled person would be able to select a suitable electrolyte bearing in mind, for example, the requirements for the reactive metal to be sufficiently reactive to remove the desired substance from the feedstock, and for the reactive metal and the reactive-metal compound to be sufficiently soluble in the electrolyte.

The method may be performed at any suitable temperature, depending on the melt composition and the material of the solid feedstock. As described in the prior art, the temperature should be sufficiently high to enable the substance to diffuse to the surface of the solid feedstock so that it can dissolve in the melt, within an acceptable time, while not exceeding an acceptable operating temperature for the melt and the reaction vessel.

Re-use of the melt includes the possibility that an apparatus for carrying out the method may comprise a reservoir containing a larger volume of melt than is required for processing a single batch of feedstock. For example, a single reservoir may feed the melt to more than one electro-reduction reaction vessel. In that case, the melt returned from each reaction vessel to the reservoir after electro-reduction of a batch of feedstock should have the predetermined composition for re-use. When melt is returned from the reservoir to a reaction vessel for processing a new batch of feedstock, the composition is then correct.

Reference is made in this document to anode current density. As in any electrochemical cell, and in particular a cell in which gas is generated at the anode, the current density may vary at different points on an anode. Consequently, references in this document to anode current density should be construed as being based on the geometrical area of an anode.

Specific embodiments of the invention will now be described by way of example, as follows.

EXAMPLE 1

An electro-reduction process is used to reduce 100 g of Tantalum pentoxide to Tantalum metal. The electrolytic cell contains 1.5 kg of molten $CaCl_2$ electrolyte and is fitted with a graphite anode of area 0.0128 $m^2$. The level of CaO in the electrolyte is 1 wt %. The mass transfer coefficient at the anode has been determined as 0.00008 $ms^{-1}$.

When a current of 15 Å is applied to the cell chlorine gas is evolved at the anode. Using equation 9 above Da=1.37. When the current is reduced to 10 Å chlorine evolution stops (Da 0.97) but the electrolysis takes 33% longer to achieve full reduction.

An identical experiment is carried out with the addition of 0.3 wt % Ca and no chlorine is evolved. Using equation 9 above Da=0.96. The electrolysis takes only 67% as long as when operating at 10 Å.

EXAMPLE 2

An electro-reduction process is used to reduce 37 g of Titanium Oxide to Titanium metal. The electrolytic cell contains 1.5 kg of molten $CaCl_2$ electrolyte and is fitted with a graphite anode of area 0.0128 $m^2$. The level of CaO in the electrolyte is 1 wt %. The mass transfer coefficient at the anode has been determined as 0.00008 $ms^{-1}$.

When a current of 15 Å is applied to the cell chlorine gas is evolved at the anode. Using equation 9 above Da=1.55. When a similar experiment is carried out using only 30 g of $TiO_2$ no chlorine is evolved (Da 0.77) but the cell loading (and hence productivity) has been reduced by 19%.

An identical experiment is carried out using 37 g of Titanium Oxide and with the addition of 0.42 wt % Ca and no chlorine is evolved. Using equation 9 above Da=0.98.

The above examples illustrate that the addition of Ca metal at the start of the electrolysis can avoid the production of chlorine at the anode and lead to higher rates of productivity. Similar outcomes may advantageously be achieved using other reactive metals in other melts, such Ba in $BaCl_2$ or Na in NaCl.

As illustrated in the Examples, preferred implementations of the invention, in which the electrolyte composition is modified by a deliberate increase in concentration of the reactive metal, may advantageously allow the current in an electro-reduction process for a predetermined batch of feedstock to be increased by more than 10% or 20% or 30%, and preferably more than 40%, above a maximum current that may be sustained without (for example) chlorine evolution in a similar process which does not involve the deliberate increase in concentration of the reactive metal. In the cell without the deliberately increased concentration of reactive metal, the (for example) chlorine evolution may not occur continuously as the feedstock is reduced (depending on the current or current profile applied) but the implementation of the invention may advantageously allow an increased current, as described above, at any point when (for example) chlorine would otherwise be evolved.

As shown in Example 2, the invention may similarly be applied to increase the mass of a batch of feedstock that can be processed in a given electrolytic cell without (for example) chlorine evolution. The mass of feedstock may advantageously be increased by more than 10% or 15% or 20%.

EXAMPLE 3

In one embodiment, a method of the invention concerns removing a substance from batches of a feedstock comprising a solid metal, containing the substance in solid solution, or a metal compound comprising the substance and a metal, to produce batches of a product comprising the metal, comprising the steps of:

(A) producing a batch of the product by;

providing a fused-salt melt comprising a fused salt, a reactive-metal compound and a reactive metal, the fused salt comprising an anion species which is different from the substance, the reactive-metal compound comprising the reactive metal and the substance, and the reactive metal being capable of reaction to remove at least a portion of the substance from the feedstock;

contacting the melt with a cathode;

contacting the cathode and the melt with a batch of the feedstock such that the batch feedstock is cathodically connected;

contacting the melt with an anode; and applying a current between the cathode and the anode to remove at least a portion of the substance from the cathodically-connected batch of feedstock so as to produce the product;

in which a portion of the applied current during step (A) is carried by a reaction in which the reactive metal in the melt is oxidized at the anode; and in which a quantity of the reactive metal in the melt is sufficient to prevent oxidation of the anion species at the anode when the current is initially applied and at all times during step (A); and then (B) applying the current between the cathode and the anode for a further period of time, during which time the product remains cathodically connected in the melt, to decompose a portion of the reactive-metal compound in the melt and so increase the quantity of the reactive metal in the melt;

in which steps (A) and (B) are carried out under current control;

(C) removing the batch of product from the melt; and (D) re-using the melt to process a further batch of feedstock as defined in steps (A) to (C);

wherein the reaction between the feedstock and the reactive-metal compound forms an intermediate compound, which reduces the concentration of the reactive-metal compound in the melt during an intermediate phase of step (A), and comprising carrying out step (B) such that said quantity of the reactive metal in the melt at an end of step (B) is above a threshold quantity, below which, application of the applied current would cause oxidation of the anion species at the anode.

We claim:

1. A method for removing a substance from batches of a feedstock comprising a solid metal, containing the substance in solid solution, or a metal compound comprising the substance and a metal, to produce batches of a product comprising the metal, comprising the steps of:

(A) producing a batch of the product by;

providing a fused-salt melt comprising a fused salt, a reactive-metal compound and a reactive metal, the fused salt comprising an anion species which is different from the substance, the reactive-metal compound comprising the reactive metal and the substance, and the reactive metal being capable of reaction to remove at least a portion of the substance from the feedstock;

contacting the melt with a cathode;

contacting the cathode and the melt with a batch of the feedstock such that the batch feedstock is cathodically connected;

contacting the melt with an anode; and applying a current between the cathode and the anode to remove at least a portion of the substance from the cathodically-connected batch of feedstock so as to produce the product;

in which a portion of the applied current during step (A) is carried by a reaction in which the reactive metal in the melt is oxidized at the anode; and in which a quantity of the reactive metal in the melt is sufficient to prevent oxidation of the anion species at the anode when the current is initially applied and at all times during step (A); and then (B) applying the current between the cathode and the anode for a further period of time, during which time the product remains cathodically connected in the melt, to decompose a portion of the reactive-metal compound in the melt and so increase the quantity of the reactive metal in the melt;

in which steps (A) and (B) are carried out under current control;

(C) removing the batch of product from the melt; and (D) re-using the melt to process a further batch of feedstock as defined in steps (A) to (C).

2. The method according to claim 1, in which the applied current is a predetermined variable current or is applied according to a predetermined current profile or is a constant current.

3. The method according to claim 1, in which a reaction between the feedstock and the reactive-metal compound changes a concentration of the reactive-metal compound in the melt during step (A).

4. The method according to claim 3, in which the reaction between the feedstock and the reactive-metal compound forms an intermediate compound, which reduces the concentration of the reactive-metal compound in the melt during an intermediate phase of step (A), and comprising carrying out step (B) such that said quantity of the reactive metal in the melt at an end of step (B) is above a threshold quantity, below which, application of the applied current would cause oxidation of the anion species at the anode.

5. The method according to claim 1, in which the melt is re-used to process 10 or more batches.

6. The method according to claim 1, in which cations of the reactive metal are correspondingly reduced at the cathode.

7. The method according to claim 1, in which the feedstock comprises a metal selected from beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, the lanthanides.

8. The method according to claim 1, in which the substance comprises oxygen.

9. The method according to claim 1, in which the reactive metal comprises Ca, Li, Na or Mg.

10. The method according to claim 1, in which the anion species comprises chloride.

11. The method according to claim 1, in which the fused salt comprises calcium chloride.

12. The method according to claim 11, in which the quantity of the reactive metal in the melt before the melt is contacted with the feedstock at a start of step (A), and at an end of step (B), is between 0.1 wt % and 0.7 wt %.

13. The method according to claim 11, in which the quantity of the reactive-metal compound in the melt before the melt is contacted with the feedstock at a start of step (A), and at an end of step (B), is between 0.5 wt % and 2.0 wt %.

14. The method according to claim 11, in which the quantity of the reactive metal in the melt before the melt is contacted with the feedstock at a start of step (A), and at an end of step (B), is between 0.2 wt % and 0.5 wt %.

15. The method according to claim 11, in which the quantity of the reactive-metal compound in the melt before the melt is contacted with the feedstock at a start of step (A), and at an end of step (B), is between 0.8 wt % and 1.5 wt %.

16. The method according to claim 1, in which a current density at the anode when the current is applied at a start of step (A) is greater than 1000 $Am^{-2}$.

17. The method according to claim 1, in which a predetermined current is applied during an intermediate phase of step (A), and lower predetermined currents are applied before and after the intermediate phase.

18. The method according to claim 1, in which the product comprising the metal is a metal product, an alloy product or an intermetallic product.

19. The method according to claim 1, in which a current density at the anode when the current is applied at a start of step (A) is greater than 1500 $Am^{-2}$.

20. The method according to claim 1, in which a current density at the anode when the current is applied at a start of step (A) is greater than 2000 $Am^{-2}$.

21. The method according to claim 1, in which the feedstock comprises a metal selected from lanthanum, cerium, praseodymium, neodymium, samarium, actinium, thorium, protactinium, uranium, neptunium or plutonium.

22. The method according to claim 1, in which the feedstock comprises a metal compound containing a metal selected from beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, the lanthanides or the actinides.

23. The method according to claim 1, in which the feedstock comprises a metal compound containing a metal selected from lanthanum, cerium, praseodymium, neodymium, samarium, actinium, thorium, protactinium, uranium, neptunium or plutonium.

24. The method according to claim 1, in which the feedstock comprises more than one metal such that the product of the method is an alloy or an intermetallic compound.

* * * * *